United States Patent [19]

Ardell et al.

[11] Patent Number: 5,042,700

[45] Date of Patent: Aug. 27, 1991

[54] PROCESS AND EQUIPMENT TO DETERMINE DISTURBANCE VARIABLES WHEN POURING MOLTEN METAL FROM A CONTAINER

[75] Inventors: Rickard Ardell, Hobart, Ind.; Armin Kursfeld, Unterägeri, Switzerland

[73] Assignee: Stopinc Aktiengesellschaft, Baar, Switzerland

[21] Appl. No.: 351,852

[22] Filed: May 12, 1989

[51] Int. Cl.[5] ..... B22D 37/00

[52] U.S. Cl. ..... 222/590; 222/591; 266/80; 164/4.1; 164/452; 164/154

[58] Field of Search ..... 164/449, 453, 501, 511, 164/4.1, 451, 452, 150, 154, 155; 266/78, 99, 245, 80; 222/590, 600, 591

[56] References Cited

U.S. PATENT DOCUMENTS

| | | | |
|---|---|---|---|
| 4,583,717 | 4/1986 | Hasegawa et al. | 164/453 |
| 4,635,832 | 1/1987 | Anghrer et al. | 164/155 |

FOREIGN PATENT DOCUMENTS

| | | | |
|---|---|---|---|
| 263742 | 7/1977 | Fed. Rep. of Germany | 164/155 |
| 47-23763 | 7/1972 | Japan | 164/453 |
| 55-97846 | 7/1980 | Japan | 164/453 |
| 57-72752 | 5/1982 | Japan | 164/150 |
| 60-148652 | 8/1985 | Japan | 164/453 |
| 61-144254 | 7/1986 | Japan | 164/150 |
| 61-212465 | 9/1986 | Japan | 164/453 |
| 61-235056 | 10/1986 | Japan | 164/453 |
| 62-263858 | 11/1987 | Japan | 164/453 |
| 872016 | 10/1981 | U.S.S.R. | 164/155 |

*Primary Examiner*—Richard K. Seidel

*Attorney, Agent, or Firm*—Wenderoth, Lind & Ponack

[57] ABSTRACT

In a method to determine disturbances when pouring molten metal from a container having an outlet channel, vibrations generated by the molten metal flowing from the container are measured at parts of the outlet and deviations from a desired vibrational characteristic are determined. From these vibrations disturbances such as blockages in the outlet channel, vortexes and, above all, the outflow of slag can be detected. With this method the reliability of the pouring process can be significantly increased.

10 Claims, 1 Drawing Sheet

FIG. 1
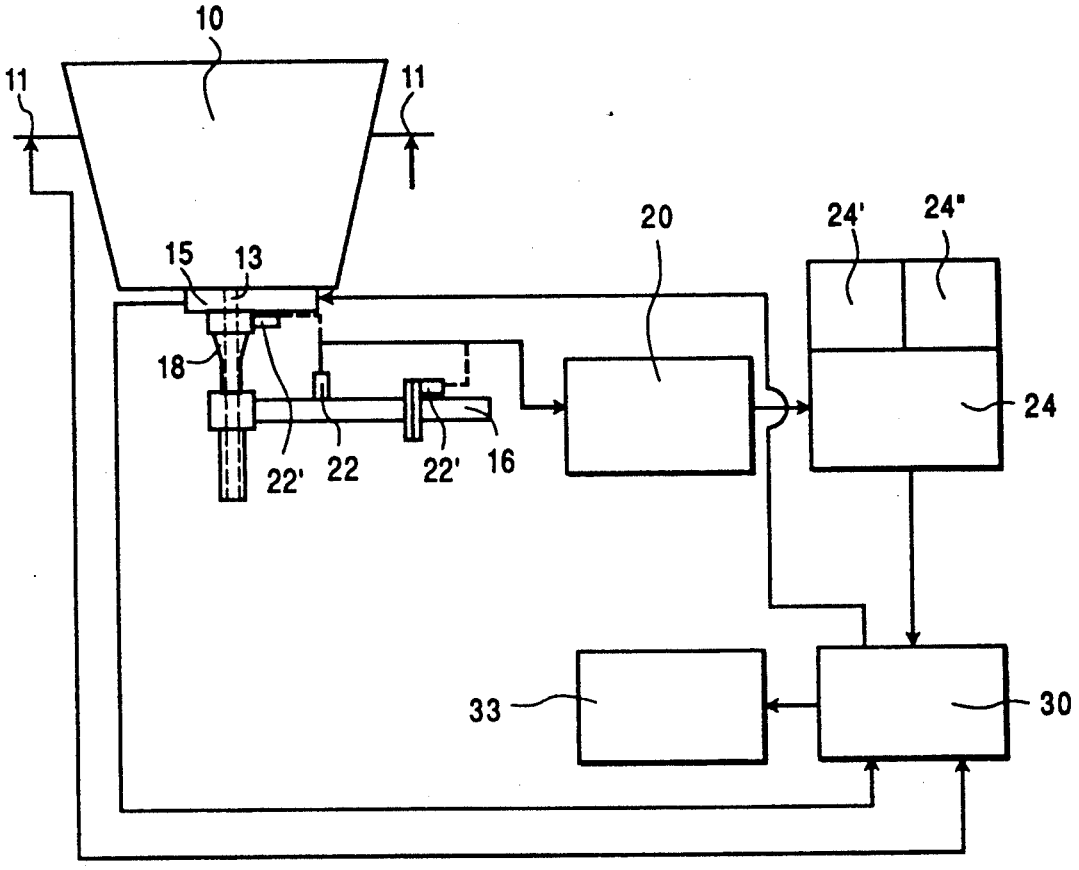
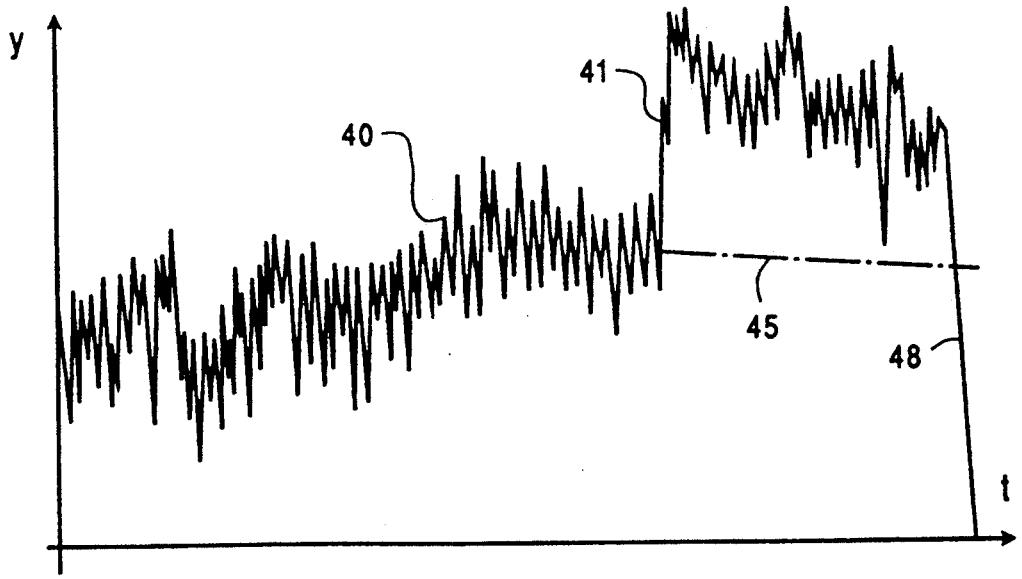
FIG. 2

PROCESS AND EQUIPMENT TO DETERMINE DISTURBANCE VARIABLES WHEN POURING MOLTEN METAL FROM A CONTAINER

BACKGROUND OF THE INVENTION

The invention relates to a method for determining disturbances when pouring molten metal from a container having an outlet channel and related parts. When pouring molten metal, disturbances occur primarily in the form of a vortex, the discharge of slag, blockages in the outlet channel and/or due to defective, refractory material forming the outlet channel.

In known methods (see, for example, the method disclosed in WO-A1 86/02583), in particular to detect slag in molten steel, voltages that are evaluated frequency-selectively are provided by means of a transmitting and receiving coil enclosing the stream of molten metal without contacting the same. The distribution of conductivity over the cross section of flow is detected and from such information the proportion of slag in the flowing molten metal is determined from a frequency analysis of voltages corresponding to said distribution. In addition to this, measurements of the changing temperature of the molten metal are used in conjunction with measured values of the induced voltage spectrum. Since said transmitting and receiving coils are subject to intensive heat, on the one hand they wear relatively rapidly, and, on the other hand, incidents that disturb normal operation cannot be ruled out. In addition to this, this method of measurement is time-consuming and, therefore, is also not reliable.

SUMMARY OF THE INVENTION

The object of the present invention is to provide a method and apparatus of the aforementioned kind by which disturbances can be determined reliably and quite simply.

According to the invention, vibrations generated by molten metal flowing from the container, through parts defining the outlet, are measured and disturbances are detected from any deviations from a desired vibrational characteristic.

In this manner disturbances during pouring can be determined early, and thus the efficiency during pouring can also be increased.

At the end of the pour when the container is almost empty, the vibrational characteristic shows an abrupt variation with respect to the desired characteristic by which the discharge of molten metal is immediately stopped or is stopped after a pre-set period of time. Thus, a pouring of slag can be avoided with certainty and at the same time the residual molten metal remaining in the container can be reduced to a minimum. In a similar manner other disturbances such as blockages in the outlet channel or the like can be determined.

The apparatus according to the invention to carry out the above-described method has a vibration measuring device on the container and/or on a part of the container outlet. Said measuring device permits, from a distance, disturbances to be detected indicative of characteristics of the molten metal which radiates quite intensive heat.

BRIEF DESCRIPTION OF THE DRAWINGS

Other objects, features and advantages of the invention are explained in detail with reference to the accompanying drawings in which:

FIG. 1 is a schematic diagram of the invention for use with a container containing molten metal; and FIG. 2 is a diagram of the vibrational characteristics as a function of time as detected according to the present invention at the end of the pour.

DETAILED DESCRIPTION OF THE PREFERRED EMBODIMENT

FIG. 1 shows a container 10 containing molten metal. The container 10 can be, for example, a ladle containing molten steel or a tundish for carrying out continuous casting. At its suspension points 11, load cells to measure the weight of the container are provided which send a signal to a process control computer 30. At the outlet of the container 10 is a closing member 15, which serves to pour a quantity of molten metal in a controlled manner and which is designed as a slide gate nozzle in the illustrated embodiment. A pouring pipe 18 that is held in position by a holding device 16 and from which the molten metal flows, for example, into a mold when the slide gate nozzle 15 is open, is sealingly joined to slide gate nozzle 15. The container 10 and the aforementioned parts 15, 18 at the outlet are made of refractory material in the region that makes contact with the liquid molten metal.

The mechanical vibrations caused by the stream of the molten metal flowing from the container 10 and transmitted through parts 15, 16, 18 are measured by a vibration measuring device 22 in which a conventional, so-called piezoelectric accelerometer can be used. The measuring device 22 is mounted on the pouring pipe holding device 16 in a vertical or horizontal direction so as to be detachable. Of course, it could also be mounted directly on the pouring pipe 18, at the slide gate nozzle 15 and/or on the container, as indicated with the measuring devices 22'. The mounting of the measuring device on the pouring pipe changing device 16 has the advantage that when changing the container 10, this device 22 and its connecting lead to the devices 20, 24 can be left. Consequently, when the ladle, for example, is changed there is no need for additional assembly or disassembly work.

Electrical signals of the vibrational amplitude y, measured by the measuring device 22, are fed to a process control computer 30 from an amplifier 20 via a filter 24, which has a high pass filter 24' and a low pass filter 24''. This process control computer 30 records the measured signals. It compares the vibrational characteristic with a desired vibrational characteristic, from which disturbance variables are detected and, when certain disturbances occur, an alarm signal 33 and/or closing member or other means are activated.

By means of the weight measurement 11 of the container 10 a signal is fed to the computer 30, from which signal the computer knows how much molten metal the container still contains. At the end of the pour, the weight determination is used as a parameter to detect the outflow of slag. The actual detection of a vortex (eddy formation in the bath) and the outflow of slag is performed by measuring the vibrational characteristic, as shown in FIG. 2. The actual characteristic 40 of the vibrational amplitudes y experiences an abrupt variation and thus a deviation from the desired characteristic 45, a condition that can be traced to vortex formation and to related outflow of slag. Having determined these disturbances, the process control computer 30 actuates an alarm 33 and the pouring is stopped by closing the slide gate nozzle 15. Such stoppage can be delayed if, as experience has shown, the slag does not exit immediately after the abrupt variation but rather after a determinable amount of time, a state that can be determined by conducting a microstructural analysis of the steel poured at the end of the pour. When the outflow is stopped, the vibration 48 drops to zero.

The vibrational amplitude 40 is approximately a linear function of the degree of opening of the closing member 15. The more the closing member is opened, the greater the vibrational amplitude and vice versa.

Another disturbance can occur if outlet channel 13 is clogged, a state resulting from alumina deposits in the channel walls. The greater the accumulation of deposits, the more the amplitude of vibration is dampened. If the process control computer 30 detects such a dampening, an alarm is triggered and countermeasures are initiated, for example, by blowing gas into the outlet channel 13 (with a device not illustrated) or by changing the opening position of the slide gate nozzle 15 for a short period of time.

With this method of measurement a defect in one or more of the refractory parts 10, 15, 18 enclosing the molten metal can be determined. Such a defect in turn manifests itself in a deviation of the vibrational amplitude from the desired amplitude. Thus, early intervention can be taken.

The present invention can be applied not merely to the arrangement illustrated in FIG. 1. Rather, the invention is just as applicable to other container systems such as a free running nozzle or other closing member (plug).

What is claimed is:

1. A method of determining disturbances when discharging molten metal from a metallurgical container having an outlet, said method comprising:

providing a measuring device, capable of detecting mechanical vibrations, in contact with a part of the outlet of the container to directly detect mechanical vibrations of the part generated by molten metal being discharged from the container through the outlet;

comparing the vibrations detected by said measuring device with a desired vibrational characteristic;

analyzing the comparison of the vibrations detected with said desired vibrational characteristic to determine the existence of a blockage in a discharge channel defined by the outlet of the container by determining when the detected vibrations attenuate to a degree with respect to said desired vibrational characteristic that is indicative of a blockage in the discharge channel defined by the outlet; and alleviating the blockage of the outlet upon the determination of the attenuation of the vibrations to said degree.

2. A method as claimed in claim 1, wherein said step of alleviating comprises introducing a stream of gas into the discharge channel.

3. A method as claimed in claim 1, wherein said step of alleviating comprises temporarily changing a degree of opening of the discharge channel.

4. A method as claimed in claim 1, and further comprising checking the discharge of molten metal whenever the detected vibrations deviate from the desired vibrational characteristic.

5. In a metallurgical container having parts constituting an outlet through which molten metal is discharged from the container, apparatus for determining disturbances when discharging molten metal from the container, said apparatus comprising:

vibration measuring means, including a respective piezoelectric accelerometer contacting at least one of the container and said parts, for directly detecting mechanical vibrations of said at least one of the container and said parts which are generated by molten metal being discharged from the container and for issuing signals representative of the vibrations detected; and computer means, operatively connected to said vibration measuring means, for storing a desired vibrational characteristic, for receiving the signals issued by said vibration measuring means, for comparing the vibrations detected by said vibration measuring means with said desired vibrational characteristic, and for analyzing the comparison of the vibrations detected with said desired vibrational characteristic to determine the existence of at least one of the outflow of slag from the container, a vortex in molten metal being discharged from the container and a blockage in a discharge channel defined by the outlet of the container.

6. In a metallurgical container, the apparatus for determining disturbances as claimed in claim 5, and further comprising measurement processing means operatively connected between said vibration measuring means and said computer means for processing the signals issued by said vibration measuring means before the signals are received by said computer means.

7. In a metallurgical container, the apparatus for determining disturbances as claimed in claim 6, wherein said measurement processing means includes a signal amplifier and at least one filter.

8. In a metallurgical container having a pour pipe through which molten metal is discharged from the container, and a holding device holding the pour pipe, apparatus for determining disturbances when discharging molten metal from the container, said apparatus comprising:

vibration measuring means, including a respective piezoelectric accelerometer mounted to said holding device, for directly detecting mechanical vibrations of said holding device which are generated by molten metal being discharged from the container and for issuing signals representative of the vibrations detected; and computer means, operatively connected to said vibration measuring means, for storing a desired vibrational characteristic, for receiving the signals issued by said vibration measuring means, for comparing the vibrations detected by said vibration measuring means with said desired vibrational characteristic, and for analyzing the comparison of the vibrations detected with said desired vibrational characteristic to determine the existence of at least one of the outflow of slag from the container, a vortex in molten metal being discharged from the container and a blockage in a discharge channel defined by the outlet of the container.

9. In a metallurgical container, the apparatus for determining disturbances as claimed in claim 8, and further comprising measurement processing means operatively connected between said vibration measuring means and said computer means for processing the signals issued by said vibration measuring means before the signals are received by said computer means.

10. In a metallurgical container, the apparatus for determining disturbances as claimed in claim 9, wherein said measurement processing means includes a signal amplifier and at least one filter.

* * * * *